United States Patent [19]

Scott

[11] Patent Number: 5,074,517

[45] Date of Patent: Dec. 24, 1991

[54] CROSS-SECTIONAL STABILIZERS FOR ELASTOMERIC CONCRETE FORM LINERS

[76] Inventor: Samuel C. Scott, 4575 Joliet St., Denver, Colo. 80239

[21] Appl. No.: 514,132

[22] Filed: Apr. 25, 1990

[51] Int. Cl.[5] ..... E04G 9/10

[52] U.S. Cl. ..... 249/112; 249/35; 249/114.1; 249/134; 249/140; 249/189; 264/338

[58] Field of Search ..... 249/16, 35, 48, 112, 249/114.1, 115, 134, 135, 140, 189; 264/338, 313, 316; 425/DIG. 44

[56] References Cited

U.S. PATENT DOCUMENTS

| | | | |
|---|---|---|---|
| Re. 29,945 | 3/1979 | Scott | 249/80 |
| 4,037,816 | 7/1977 | Scott | 249/83 |
| 4,150,808 | 4/1979 | Sawyer | 249/112 |
| 4,798,364 | 1/1989 | Scott | 249/189 |
| 4,887,789 | 12/1989 | Harris et al. | 249/16 |

FOREIGN PATENT DOCUMENTS

| | | | |
|---|---|---|---|
| 3239975 | 5/1984 | Fed. Rep. of Germany | 249/112 |
| 1435731 | 11/1988 | U.S.S.R. | 249/16 |

OTHER PUBLICATIONS

The Scott System Brochure, "A Low Cost Technique for Architectural Concrete Surfaces", received 12/1971, copy in class 249, subclass 112.

Product report, "Rustication Strips", Symons Mfg. Company, Aug. 8, 1978.

*Primary Examiner*—James C. Housel

*Attorney, Agent, or Firm*—James E. Pittenger

[57] ABSTRACT

A flexible reinforced concrete form line is provided which includes a plurality of elongated cuttable strips which are sized and embedded within the textured surface of the flexible form liner. The cross-sectional shape of the strips is substantially the same as the cross-sectional shape of the textured surface of the liner except smaller so that the thickness of the elastomeric material making up the liner is substantially constant throughout resulting in consistent expansion and contraction of the liner during setting of the concrete. The strips can be suspended within the liner during the elastomeric molding process or the strips can be directly attached to the plywood form backing sheet prior to the molding process. The total quantity of elastomeric material making up the liner can be greatly reduced which, in turn, reduces the weight of the overall form.

10 Claims, 2 Drawing Sheets

CROSS-SECTIONAL STABILIZERS FOR ELASTOMERIC CONCRETE FORM LINERS

FIELD OF THE INVENTION

This invention is directed to a method for improving reinforced form liners for concrete construction. It is more specifically directed to a method and resulting apparatus providing stabilizing ribs within the flutes of elastomeric concrete form liners for reducing the volume of elastomeric material within the flutes and adding additional strength to the liner itself.

BACKGROUND OF THE INVENTION

This invention is an improvement of my earlier invention described in United States Patent No. 4,798,364 which provides a novel and unique way of making and using a plywood form liner which is rigid and easy to handle as well as eliminating edge leakage even though the form liner may be reused a considerable number of times.

In using the reinforced form liner which is described and claimed in my above-identified patent, it has been found that the heat which is generated during the setting of the concrete after it has been poured into the forms causes the relatively thick fluted portions of the elastomeric concrete form liner to expand and contract at different rates across the cross section of the liner. Because of the mass of the elastomeric material which is present within the form liner, especially those which are used to texture the outer surface of the finished concrete, the expansion and contraction of the various portions the liner causes the final shape of the set concrete to take on an hourglass appearance. Thus when looking at a cross section of the elastomeric form liner, especially those that produce an elongated parallel ridge and valley configuration in the concrete surface, the portion of the liner which produces the valleys in the finished configuration contain a large mass of elastomeric material. On the other hand, the thin web between these portions which form the ridge in the concrete surface is relatively thin in comparison and thus has a different dimensional expansion or contraction when placed in use.

It is believed that the reinforcing sheet which is molded to the back of the elastomeric concrete liner in the present invention helps to minimize the expansion and contraction movement of the liner, but movement still takes place especially in the area of the elastomer located furthest away from the reinforcing sheet.

In addition, because of the density of the elastomeric material which is used in this type of product the reinforced concrete liner is quite heavy which makes it more difficult to handle by construction workers. As a result, it is desirable to reduce the amount of elastomeric material which is utilized in the construction of the reinforced form liner and thus in turn reduce the overall weight of the finished liner and eliminate the expansion problem. It has been found that the inclusion of stabilizing strips usually fabricated from wood within the fluted area of the reinforced concrete form not only reduces the weight of the finished form, but reduces the amount of elastomeric material that is used in the molding of the liner so that the actual thickness of the elastomeric material whether it is in the web area or in the fluted area is essentially the same. Thus, the expansion problem that exists with the prior art form liners can be essentially eliminated with the arrangement which is provided in the present application.

Another problem that has existed in the prior art is the method which has been used in the past to attach the flexible concrete liner to the forms and the necessity for using whalers, stringers or strengtheners on the outside of the form structure to provide vertical and horizontal strength to support the weight of the concrete. At the present time in many cases, the flexible concrete form liner used with conventional forms is glued to plywood sheeting which forms the back of the form. In the novel concrete form liner which is described in my above-identified patent the elastomeric liner material which contains the texture for the face of the finished concrete is molded and adhered directly to the plywood backing sheet during the molding process. The elastomeric material provided around the outside edges of the plywood sheet also provides a watertight seal around the outside edges which prevents loss of water from the concrete after it has been placed in the form so that complete bonding of the concrete will take place during the setting process.

An object of the present invention is to provide wooden reinforcing strips embedded within the elastomeric material as a base for nailing or fastening the conventional elastomeric form liner to a form plywood sheet. In this way, the elastomeric liner can be removed if and when it is desired which is impossible if the liner has been glued or molded permanently to the backing sheet.

A problem also has been found when using premolded elastomeric form liners in the field. When it is necessary to cut the form liner to custom fit a particular area in the construction, the elastomeric material especially in an area having a large mass causes a hand saw or an electric rotary or saber saw to bind, making it difficult to cut the material especially on a curved line. It is felt that the inclusion of cuttable stabilizing strips embedded in the elastomeric material especially when the strips are made from wood greatly reduces or eliminates this problem. The presence of the wood within the form liner apparently allows the saw teeth to clear themselves from the elastomeric material to greatly reduce the binding of the saw blade.

INFORMATION DISCLOSURE STATEMENT

The following patents which are believed to be pertinent to the subject matter of this invention are presented in compliance with the inventor's duty to disclose all information of which he is aware.

The Scott patent (U.S. Pat. No. 4,798,364) shows a flexible surface plywood concrete form liner which includes a flat planar sheet of relatively thick plywood material which is coated with a layer of textured flexible or elastomeric material. The texturing causes the thickness of the material to vary across the cross section of the form.

The Scott patent (U.S. Pat. No. Re 29,945) discloses a multiple use elastomeric or flexible liner having a rigid panel backing the flexible elastomeric negative mold liner. The panel provides rigidity to the liner and allows it to be used in the concrete form. In this arrangement, the liner is formed separately and is attached to the surface of the backup panel by suitable means such as adhesives.

The Scott patent (U.S. Pat. No. 4,037,817) discloses an arrangement for an upright or vertical mold for forming a planar flexible elastomeric liner for concrete forms. The mold includes a positive master of the texture provided on the flexible liner. The master is secured to the planar backing which forms a portion of the mold. A planar form member forming the back of the molded liner is positioned in the mold opposite the positive master surface. The liquid elastomer is poured into the edge of the upright mold with excess material provided along the top edge.

SUMMARY OF THE INVENTION

The present invention is directed to a method and the resulting product which utilizes strategically placed low-density cuttable strips of material within the high volume, high density areas of flexible elastomeric concrete form liners. The use of the embedded strips is exceedingly helpful in the type of form liner which has parallel flutes which run horizontally or vertically in the form.

According to the present invention, strips having a rectangular, square or truncated triangular cross-section are suspended or arranged in the fluted areas of the mold prior to introducing the elastomeric material. Thus, the cross-sectional shape of the strip and the positioning of the strip within the mold is intended to essentially maintain the thickness of elastomeric material within the mold at a relatively constant thickness. Thus, the inconsistencies of the expansion and contraction of the elastomeric material within the form when the concrete is poured is virtually eliminated. Because of the constant thickness of the elastomeric material, the material essentially expands uniformly, thus providing a consistent and desirable design configuration in the surface of the finished concrete.

The strip which can be of any cuttable material such as wood, plastic, synthetic foam or any other suitable material can be suspended in the mold or fastened directly to the plywood backing sheet prior to the sheet being inserted into the mold during the manufacturing process. In either case, the inclusion of the relatively rigid strips provides additional reinforcing to the overall flexible liner which makes it easier to handle and yet, light due to the reduced amount of elastomeric material that is required during the molding process. It also appears that the presence of the cuttable material, especially when wood is used, greatly reduces or eliminates the saw blade binding problem which has been mentioned above. The presence of the wood within the form liner allows the saw teeth to clear themselves during the cutting process which greatly reduces the actual binding of the saw blade in the elastomeric form material.

It has also been found that the use of the reinforcing or filler strips within the fluted areas of the flexible concrete liner allows a separate flexible liner to be secured to a plywood sheet by the use of nails or screws. In this way, the elastomeric flexible liner can be removed, if desired, which is impossible to do if the liner is glued or molded directly to the backing sheet.

Thus, it has been found that the method of making a form liner according to the present invention essentially eliminates the problems that exist with the prior art flexible form liners. As a result, the present flexible liner including the embedded reinforcement or filler strips provides a vastly improved product which was never anticipated in the prior art liners or patents which have issued previously.

Other features and advantages of the present invention will become apparent from the following detailed description of the invention when it is considered in conjunction with the accompanying drawings.

DETAILED DESCRIPTION OF THE INVENTION

Figure 1:
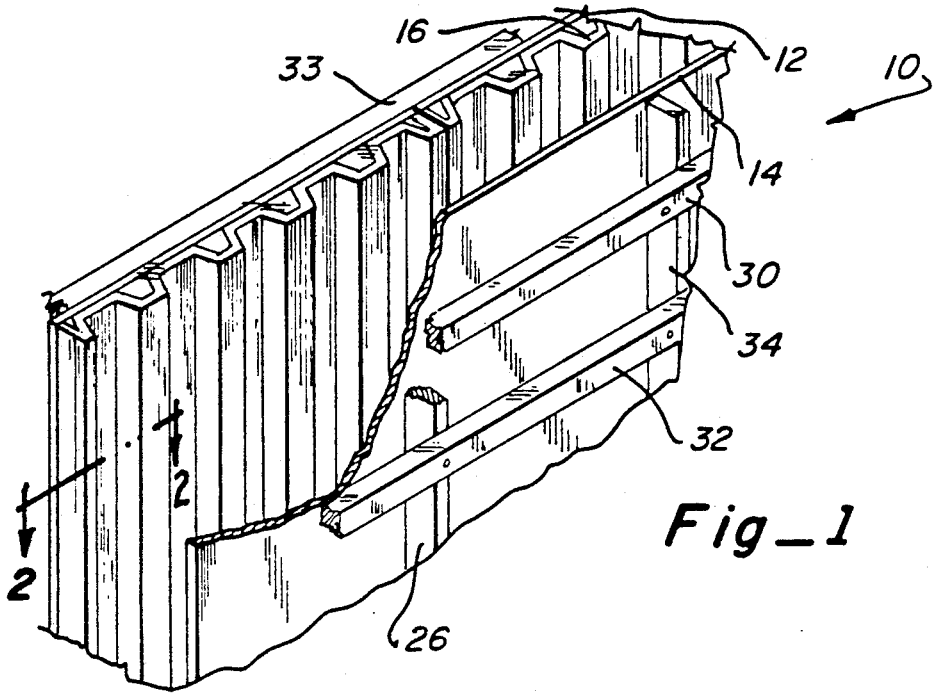
FIG. 1 is a perspective view of a double-faced concrete form showing a reinforced flexible form liner according to the present invention forming the inside surface of one wall of the form.
Figure 2:
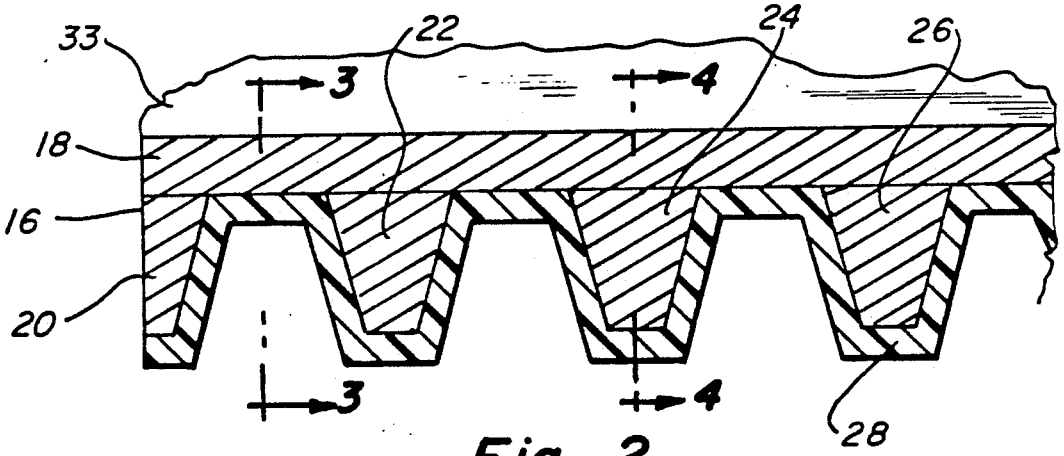
FIG. 2 is a partial cross-sectional view taken along lines 2—2 of FIG. 1 which shows the generally constant thickness of the elastomeric material forming the liner.

Turning now more specifically to the drawings, FIG. 1 is a double-faced vertical concrete wall form !0 having sides 12 and 14. The one side 12 is made up of a reinforced flexible concrete form 16 which is comprised of a plywood backing sheet 18, a plurality of reinforcing strips 20, 22, 24, 26 and a layer of suitable settable material, such as an elastomer.

The elastomeric material which can be used in this type of product is similar to that which is shown and described in my prior United States patents.

The combination of the strips formed from any suitable rigid cuttable material such as wood, plastic, synthetic foam, etc. and the elastomeric material forming the layer or coating on the inside surface of the plywood form sheet 18 is intended to impart a negative textured or raised pattern mold surface having a desired configuration which will impart the desired texturing effect to the outside surface of the finished concrete. Thus, the thickness and cross-sectional shape of these components can be arranged as desired to impart the desired texturing pattern.

Throughout this application it is intended that the inclusion of the filler strips within the mold or on the interior surface of the plywood form sheet can have any cross-sectional shape desired with the intent being that the strips will impart a finished contour to the elastomeric material which will have a continuous, constant thickness. By maintaining a constant thickness, a controlled expansion and contraction throughout the flexible form liner can be obtained while it is in use.

As can be seen, in FIG. 1 the outside surface of the non-reinforced form side 14 is held in position by whalers 34 and 36 and stringers 30, 32. These members placed vertically and horizontally along the outside surface of the form walls provide rigidity and strength to the overall form to support the weight of the concrete placed therein.

Figure 3:
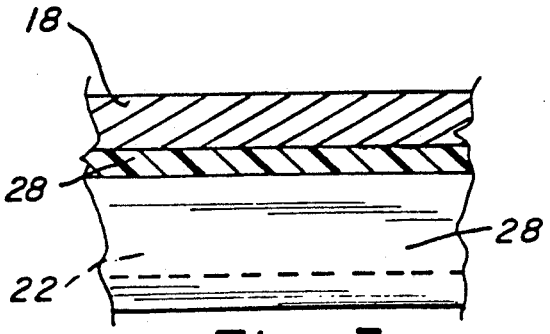
FIG. 3 is a partial cross-sectional view taken along lines 3—3 of FIG. 2.
Figure 4:
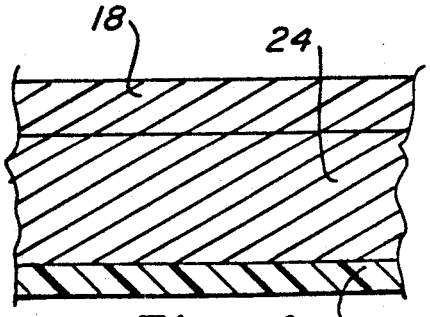
FIG. 4 is a partial cross-sectional view taken along lines 4—4 of FIG. 2.

In using the reinforced flexible concrete form 16 according to the present invention, it is possible to eliminate at least half if not all of the whalers that would normally be used in reinforcing and constructing the overall form. This provides a substantial savings in time and materials in the construction of the wall form. As seen in FIGS. 3 and 4, the elastomeric layer of material covering the inside surface and forming the flexible liner has a generally constant thickness throughout. Thus, depending upon the configuration of the design provided in the flexible liner, the wood strips 20, 22, 24, 26 vary in thickness, shape and length to provide this desired result. The constant thickness of the elastomeric material forming the liner greatly reduces the weight of the finished reinforced liner and form due to a reduction in the amount of elastomer that is used to form the textured face.

Figure 5:
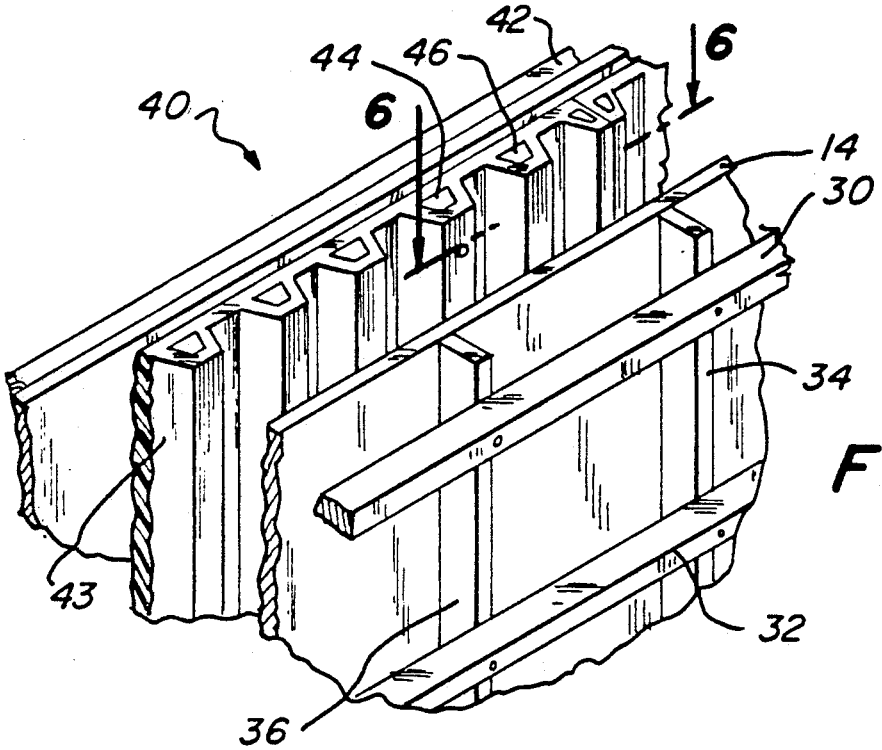
FIG. 5 shows a perspective view of a double-faced concrete form showing another embodiment of the reinforced flexible liner according to the present invention secured to a plywood sheet forming the surface of one wall of the form.
Figure 6:
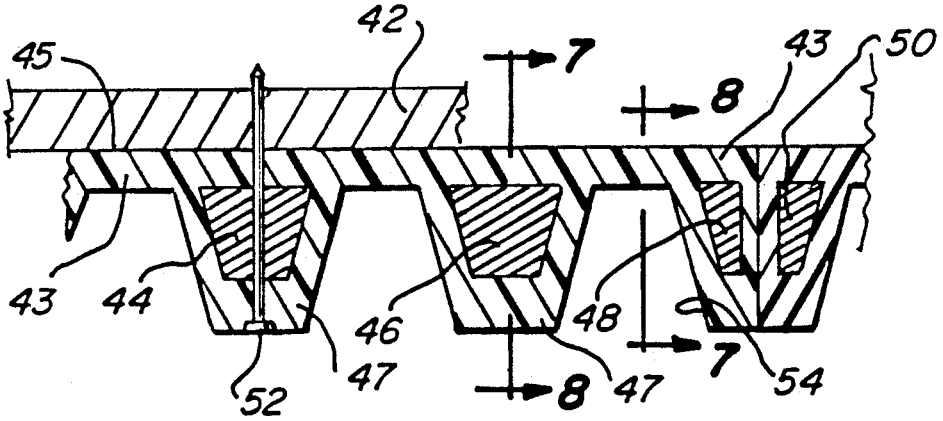
FIG. 6 is a partial cross-sectional view taken along lines 6—6 of FIG. 5.
Figure 7:
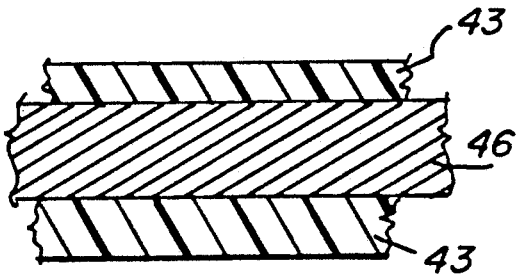
FIG. 7 is a partial cross-sectional view taken along lines 7—7 of FIG. 6.
Figure 8:
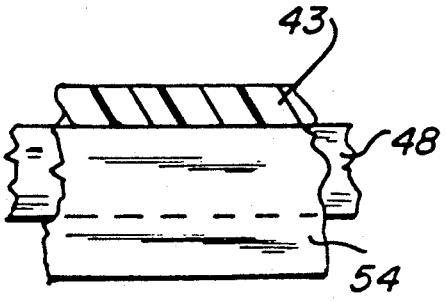
FIG. 8 is a partial cross-sectional view taken along lines 8—8 of FIG. 6.

In FIG. 5, another embodiment 40 of the reinforced form liner 42 is provided according to the present invention which includes the reinforced filler strips 44, 46, 48, 50 which are suspended in the high volume areas of the flexible liner 43 prior to molding the liner. In this way, the strips are spacedly positioned in the liner and can have any cross-sectional configuration desired such as the square cross-section which is shown in FIG. 6. The important considerations in this embodiment are the size and position the strips 44, 44, 48, 50 which are positioned substantially in the center of the cross-sectional area having the greatest mass of elastomeric material. Thus, the strips not only reinforce the flexible liner when finished, but also substantially fill the thickest portions of the liner to reduce the overall amount of elastomer that is used in the molding process. This type of liner can be fastened directly to the inside surface 45 of the plywood sheet 42 making up the concrete form. With the strip embedded in the elastomeric material, it is feasible to now support and secure the flexible liner 43 directly to the plywood sheet 42 by means of suitable fasteners 52 such as nails or screws. In this way, the direct adhesion of the surface of the flexible liner 43 to the plywood sheet 42 can be eliminated so that the liner can be separated from the sheet after use. In this way, the plywood sheet 42 can be replaced periodically when the need arises so that the more expensive flexible liner 43 can be reused a greater number of times.

It is to be understood that throughout this application the cross-sectional shape of the filler strips embedded within the elastomer of the liner can be varied to any shape desired. It is acknowledged that the truncated triangle arrangement is preferred where the sides 54 of the flutes 47 are angled in order to generally maintain the constant elastomeric thickness throughout the liner. However, as can be easily understood, any shape can be provided which will approximate the outer contour of the flexible liner to provide this desired effect. The important consideration is to reinforce the face of the liner and maintain the generally constant thickness of the elastomeric material to obtain the desired unique results.

While a method and apparatus for providing a reinforced flexible concrete form liner have been described and shown in detail in this application, it is to be understood that this invention is not limited to the exact method and form disclosed and changes in detail and construction may be made without departing from the spirit thereof.

What is claimed is:

1. A reinforced flexible concrete form liner having a raised pattern outer surface which can be used to form a textured surface in concrete wall construction, said reinforced form liner comprising:

a) a sheet of resilient material having a raised pattern surface on one side thereof; and a plurality of elongated rigid strips embedded within the raised pattern of the sheet of resilient material so that the thickness of the resilient material is generally constant throughout the cross-section of said liner.

2. A reinforced form liner as defined in claim 1 wherein said resilient material is an elastomer.

3. A reinforced form liner as defined in claim 2 wherein the raised pattern surface of said sheet material is defined by a plurality of elongated flutes, and said strips are positioned within and extend the length of the flutes.

4. A reinforced form liner as defined in claim 3 wherein the flutes formed in the outer surface of said planar sheet are substantially parallel.

5. A reinforced form liner as defined in claim 3 wherein the rigid strips have a cross sectional configuration which approximates the outer configuration of the flutes.

6. A reinforced form liner as defined in claim 1 wherein the sheet is attached to a concrete form panel by fastener means which are spacedly installed through said rigid strips.

7. A flexible surfaced plywood concrete form which can be used to form a textured surface in concrete wall construction, said form comprising:

a) a flat planar sheet of plywood material;

b) a layer of flexible, elastomeric material, said elastomeric material being formed around and bonded to said sheet, said layer of elastomeric material being formed with a raised pattern outer surface which is used to texture the surface of said concrete wall construction; and c) a plurality of elongated, rigid reinforcing strips, said strips are attached to the surface of said plywood material and are arranged to coincide with the raised pattern formed in the outer surface of said elastomeric material, said strips having a cross-sectional configuration which substantially duplicates the outer configuration of the outer surface of said elastomeric material so that the thickness of the elastomeric material is substantially constant across the surface of the form.

8. A concrete form liner as defined in claim 7 wherein the raised pattern outer surface of said elastomeric material is formed in elongated parallel flutes and said strips are positioned centrally in each of said flutes.

9. A concrete form liner as defined in claim 8 wherein the elongated flutes have outwardly angled surfaces and the outer surfaces of the reinforcing strips are arranged parallel thereto.

10. A concrete form liner as defined in claim 8 wherein the cross-sectional configuration of the reinforcing strips is a rectangle.

* * * * *